US008881944B2

(12) United States Patent
Paas et al.

(10) Patent No.: US 8,881,944 B2
(45) Date of Patent: Nov. 11, 2014

(54) OVERCAP FOR AND A METHOD OF ACTUATING A VOLATILE MATERIAL DISPENSER

(75) Inventors: Edward L. Paas, Los Altos, CA (US); Lawrence J. Kelly, Fairfield, OH (US); William W. Wichman, Cincinnati, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 1788 days.

(21) Appl. No.: 12/164,334

(22) Filed: Jun. 30, 2008

(65) Prior Publication Data

US 2009/0321381 A1 Dec. 31, 2009

(51) Int. Cl.
*B65D 83/20* (2006.01)
*B65D 83/22* (2006.01)

(52) U.S. Cl.
CPC ..... *B65D 83/206* (2013.01); *B65D 83/201* (2013.01); *B65D 83/22* (2013.01)
USPC ..... 222/1; 222/402.13; 222/402.15

(58) Field of Classification Search
CPC ... B65D 83/201; B65D 83/205; B65D 83/206
USPC ..... 222/402.13, 402.1, 402.15, 182
See application file for complete search history.

(56) References Cited

U.S. PATENT DOCUMENTS

| | | | | |
|---|---|---|---|---|
| 3,143,254 | A | | 8/1964 | Vanderhyde |
| 3,158,292 | A | | 11/1964 | O'Donnell |
| 3,169,673 | A | | 2/1965 | Focht |
| 3,172,582 | A | * | 3/1965 | Belpedio ..... 222/473 |
| 3,185,349 | A | | 5/1965 | Sagarin |
| 3,189,232 | A | * | 6/1965 | Joffe ..... 222/402.13 |
| 3,236,421 | A | * | 2/1966 | Glazier ..... 222/402.13 |
| 3,698,604 | A | | 10/1972 | Nigro |
| 3,729,119 | A | | 4/1973 | Sette et al. |
| 3,739,941 | A | * | 6/1973 | Ostrwosky et al. ..... 222/153.11 |
| 3,848,778 | A | | 11/1974 | Meshberg |
| 3,860,149 | A | | 1/1975 | Hagianis |
| 3,877,934 | A | * | 4/1975 | Schmidlin ..... 430/117.4 |
| 3,888,392 | A | * | 6/1975 | Van Coney ..... 222/108 |
| 3,946,911 | A | | 3/1976 | Morane et al. |
| 4,053,090 | A | | 10/1977 | Kelly et al. |

(Continued)

FOREIGN PATENT DOCUMENTS

| | | |
|---|---|---|
| AU | 123566 | 5/1995 |
| AU | 123732 | 6/1995 |

(Continued)

OTHER PUBLICATIONS

International Search Report and Written Opinion dated Feb. 4, 2010 Appl. No. PCT/US2009/003731.

*Primary Examiner* — Daniel R Shearer

(57) ABSTRACT

An overcap for a volatile material dispenser includes a housing adapted to be mounted on a container. The container has a valve stem with a discharge end. The overcap includes a valve-connecting portion adapted to engage the valve stem and a fixture that extends from the valve-connecting portion. The overcap further includes a trigger attached to the housing by a hinge that is disposed at or below a plane formed by the fixture. A contact portion is disposed in the trigger for interacting with the fixture and applying pressure to the valve-connecting portion to actuate the valve stem.

20 Claims, 10 Drawing Sheets

(56) References Cited

U.S. PATENT DOCUMENTS

| | | | | |
|---|---|---|---|---|
| 4,325,497 | A | 4/1982 | Ewald | |
| 4,354,621 | A * | 10/1982 | Knickerbocker | 222/47 |
| 4,378,081 | A * | 3/1983 | van Lit | 222/402.13 |
| 4,442,955 | A | 4/1984 | Bush | |
| 4,456,153 | A * | 6/1984 | Meshberg | 222/321.8 |
| 4,506,808 | A | 3/1985 | Goncalves | |
| 4,679,713 | A | 7/1987 | Crapser et al. | |
| 4,805,839 | A | 2/1989 | Malek | |
| 4,898,307 | A | 2/1990 | Tiramani | |
| 5,018,647 | A | 5/1991 | Abplanalf | |
| 5,114,052 | A | 5/1992 | Tiramani et al. | |
| 5,154,323 | A | 10/1992 | Query et al. | |
| 5,242,090 | A | 9/1993 | Reyss | |
| 5,388,730 | A | 2/1995 | Abbott et al. | |
| 5,503,303 | A * | 4/1996 | LaWare et al. | 222/153.12 |
| 5,507,437 | A | 4/1996 | Foster et al. | |
| 5,509,608 | A | 4/1996 | Foster et al. | |
| 5,513,800 | A | 5/1996 | Foster et al. | |
| 5,586,693 | A | 12/1996 | De Laforcade | |
| 5,597,095 | A | 1/1997 | Ferrara, Jr. | |
| 5,649,645 | A | 7/1997 | Demarest et al. | |
| 5,890,632 | A | 4/1999 | Chalupsky et al. | |
| 5,899,623 | A | 5/1999 | De Laforcade | |
| 5,915,597 | A | 6/1999 | De Laforcade | |
| 5,975,376 | A | 11/1999 | Chelupsky et al. | |
| 5,984,149 | A | 11/1999 | Thanisch et al. | |
| 5,984,151 | A | 11/1999 | Lohrman et al. | |
| 6,216,912 | B1 | 4/2001 | Keung et al. | |
| 6,340,103 | B1 * | 1/2002 | Scheindel et al. | 222/402.15 |
| 6,364,171 | B1 | 4/2002 | Chalupsky et al. | |
| 6,390,341 | B1 | 5/2002 | Ohmi et al. | |
| 6,454,139 | B1 | 9/2002 | Bayer | |
| RE38,022 | E | 3/2003 | De Laforcade | |
| 6,564,977 | B2 | 5/2003 | Uemura et al. | |
| 6,595,393 | B1 | 7/2003 | Loghman-Adham et al. | |
| 6,763,979 | B2 | 7/2004 | Yamanaka et al. | |
| 6,899,253 | B2 | 5/2005 | Uemura et al. | |
| 6,908,017 | B2 | 6/2005 | Mineau et al. | |
| 6,981,616 | B2 | 1/2006 | Loghman-Adham et al. | |
| 7,017,785 | B2 | 3/2006 | Lasserre et al. | |
| 7,104,427 | B2 | 9/2006 | Pericard et al. | |
| 7,204,393 | B2 * | 4/2007 | Strand | 222/402.13 |
| 2004/0222246 | A1 | 11/2004 | Bates et al. | |
| 2005/0017026 | A1 | 1/2005 | Yerby | |
| 2005/0017027 | A1 | 1/2005 | Yerby et al. | |
| 2006/0151547 | A1 | 7/2006 | Kolanus | |
| 2007/0023457 | A1 | 2/2007 | O'Toole | |
| 2007/0034649 | A1 | 2/2007 | Smith et al. | |
| 2007/0034653 | A1 | 2/2007 | Strand | |
| 2007/0051754 | A1 | 3/2007 | Strand et al. | |
| 2007/0062980 | A1 | 3/2007 | Bates et al. | |
| 2007/0138214 | A1 | 6/2007 | De'Padova et al. | |
| 2007/0278253 | A1 | 12/2007 | Ruiz De Gopegui et al. | |

FOREIGN PATENT DOCUMENTS

| | | | |
|---|---|---|---|
| AU | 2002242208 | | 2/2002 |
| AU | 2003262671 | | 8/2003 |
| AU | 301098 | | 3/2005 |
| AU | 304906 | | 1/2006 |
| AU | 304946 | | 1/2006 |
| AU | 304947 | | 1/2006 |
| AU | 307717 | | 7/2006 |
| AU | 307718 | | 7/2006 |
| AU | 313097 | | 2/2007 |
| AU | 316109 | | 9/2007 |
| AU | 318460 | | 3/2008 |
| AU | 318461 | | 3/2008 |
| AU | 318462 | | 3/2008 |
| AU | 318587 | | 3/2008 |
| AU | 318588 | | 3/2008 |
| AU | 319055 | | 5/2008 |
| AU | 319279 | | 5/2008 |
| AU | 319280 | | 5/2008 |
| AU | 320881 | | 9/2008 |
| EP | 160 816 | | 11/1985 |
| EP | 385 077 | | 9/1990 |
| EP | 575 213 | | 12/1993 |
| EP | 642 990 | | 3/1995 |
| EP | 642 991 | | 3/1995 |
| EP | 693 439 | | 1/1996 |
| EP | 0852209 | | 7/1998 |
| EP | 1 471 013 | | 10/2004 |
| GB | 1523118 | | 8/1978 |
| GB | 2 261 618 | | 5/1993 |
| JP | 63-4528 | | 2/1988 |
| JP | 63-152666 | | 10/1988 |
| JP | 2-8565 | | 1/1990 |
| JP | 2-150055 | | 12/1990 |
| JP | 4-102570 | | 4/1992 |
| JP | 8-18628 | | 2/1996 |
| JP | 2002166982 | A * | 6/2002 |
| JP | 2003-305390 | | 10/2003 |
| JP | 3559362 | | 5/2004 |
| JP | 2006-511349 | | 4/2006 |
| JP | 2006-347628 | | 12/2006 |
| JP | 2008-136909 | | 6/2008 |
| KR | 1998-059650 | | 10/1998 |
| KR | 20-0222263 | | 5/2001 |
| KR | 10-0775776 | | 11/2007 |
| WO | WO 98/11001 | | 3/1998 |
| WO | WO 99/11386 | | 3/1999 |
| WO | WO 02/064449 | | 8/2002 |
| WO | WO 2004/024221 | | 3/2004 |
| WO | WO 2004/099029 | | 11/2004 |
| WO | 2005087617 | A1 | 9/2005 |
| WO | WO 2006/058627 | | 6/2006 |
| WO | WO 2007/021918 | | 2/2007 |
| WO | WO 2007/022422 | | 2/2007 |
| WO | WO 2007/140407 | | 12/2007 |
| WO | WO 2007/149459 | | 12/2007 |

* cited by examiner

OVERCAP FOR AND A METHOD OF ACTUATING A VOLATILE MATERIAL DISPENSER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to an overcap for a volatile material dispenser, and more particularly, an overcap to aid in dispensing contents from the dispenser.

2. Description of the Background of the Invention

Volatile material dispensers generally include a container where a material in the form of a fluid or other viscous state is stored and an overcap having an actuator or trigger for dispensing the fluid from the container in aerosol or other form. A valve-connecting portion is fluidly connected to a valve stem that extends from the container, wherein the valve-connecting portion provides a path of travel for fluid to exit the container. The actuator is generally connected to or disposed adjacent the valve-connecting portion such that downward pressure on the actuator and/or the valve-connecting portion actuates the valve stem to dispense the fluid upwardly. This downward motion is oftentimes difficult for the elderly or for those persons with disabilities, such as arthritis.

In some instances, an aerosol container in the form of a pressurized product dispenser includes a valve mechanism at the top of the container for discharging product upwardly and a valve actuation lever pivotally connected to the valve mechanism. The valve actuation lever extends parallel to a longitudinal axis of the container. Pressure may be applied to the lever such that the lever actuates the valve mechanism, thereby releasing pressurized product from within the dispenser.

In another instance, an overcap for attachment to an aerosol container includes a housing having a generally rectangularly-shaped opening therethrough, a separately molded L-shaped trigger portion adapted to be inserted into the housing through the opening, a tube connected to a valve stem of the container and having a channel therethrough, and a nozzle disposed at an end of the tube. The trigger, the tube, and the nozzle are disposed within the housing and the housing is covered by a cap that acts to close the housing off from the ambient environment. Pressure is applied to the trigger, thereby putting pressure on the tube and displacing the tube to result in the dispensing of liquid product in aerosol form from the container.

A further dispenser includes a reservoir having an actuator stem, a cap-shaped push button, and a retaining ring. The retaining ring is connected to the push button by one or more swivel joints and/or several movable tabs so as to allow upward and downward movement of the push button. The tabs are joined to the retaining ring or push button, wherein a first end of each tab is situated in a plane that is perpendicular to a longitudinal axis of the reservoir and contains the axis of the swivel joint and a second end of each tab is joined to the push button. When the push button is depressed downwardly, a pin extending downwardly from the push button contacts the actuator stem to release the material contained within the reservoir.

SUMMARY OF THE INVENTION

According to one aspect of the present invention, an overcap for a volatile material dispenser includes a housing adapted to be mounted on a container having a valve stem with a discharge end. The overcap further includes a valve-connecting portion adapted to engage the valve stem and a fixture that extends from the valve-connecting portion. Still further, the overcap includes a trigger attached to the housing by a hinge, wherein the hinge is disposed at or below a plane formed by the fixture. A contact portion is disposed in the trigger for interacting with the fixture and applying pressure to the valve-connecting portion to actuate the valve stem.

According to a further aspect of the present invention, an overcap for a volatile material dispenser includes a housing adapted to be mounted on a container having a valve stem with a discharge end. The overcap includes a valve-connecting portion adapted to engage the valve stem and a fixture that extends from the valve-connecting portion. The overcap further includes a trigger having a first end and a second end. The trigger includes a contact portion that engages the fixture to actuate the valve stem, a hinge that integrally attaches the first end of the trigger to the housing, and a one-way snap that attaches the second end of the trigger to the housing.

In yet another aspect of the present invention, a method of actuating a volatile material dispenser includes the step of providing a volatile material dispenser. The dispenser includes a housing adapted to be mounted on a container having a valve stem with a discharge end, a valve-connecting portion adapted to engage the valve stem, a fixture extending from the valve-connecting portion, a trigger integrally attached to the housing at or below a plane formed by the fixture, and a contact portion disposed in the trigger. The method further includes the step of pressing the trigger in a direction generally parallel to the plane defined by the fixture, such that the trigger movement allows the contact portion to interact with the fixture to thereby displace the valve-connecting portion.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

The present invention is directed to apparatuses and methods for aiding in actuating a volatile material dispenser. While the present invention may be embodied in many different forms, several specific embodiments are discussed herein with the understanding that the present disclosure is to be considered only as an exemplification of the principles of the invention, and it is not intended to limit the invention to the embodiments illustrated. For example, where the invention is illustrated herein with particular reference to an aerosol container, it will be understood that any other pressurized or non-pressurized container, such as, for example, any package, usually a metal can or plastic bottle, designed to dispense the contents thereof as a mist or foam, may be, if desired, substituted in whole or in part for the aerosol container in the apparatuses and methods herein described.

Figure 1:
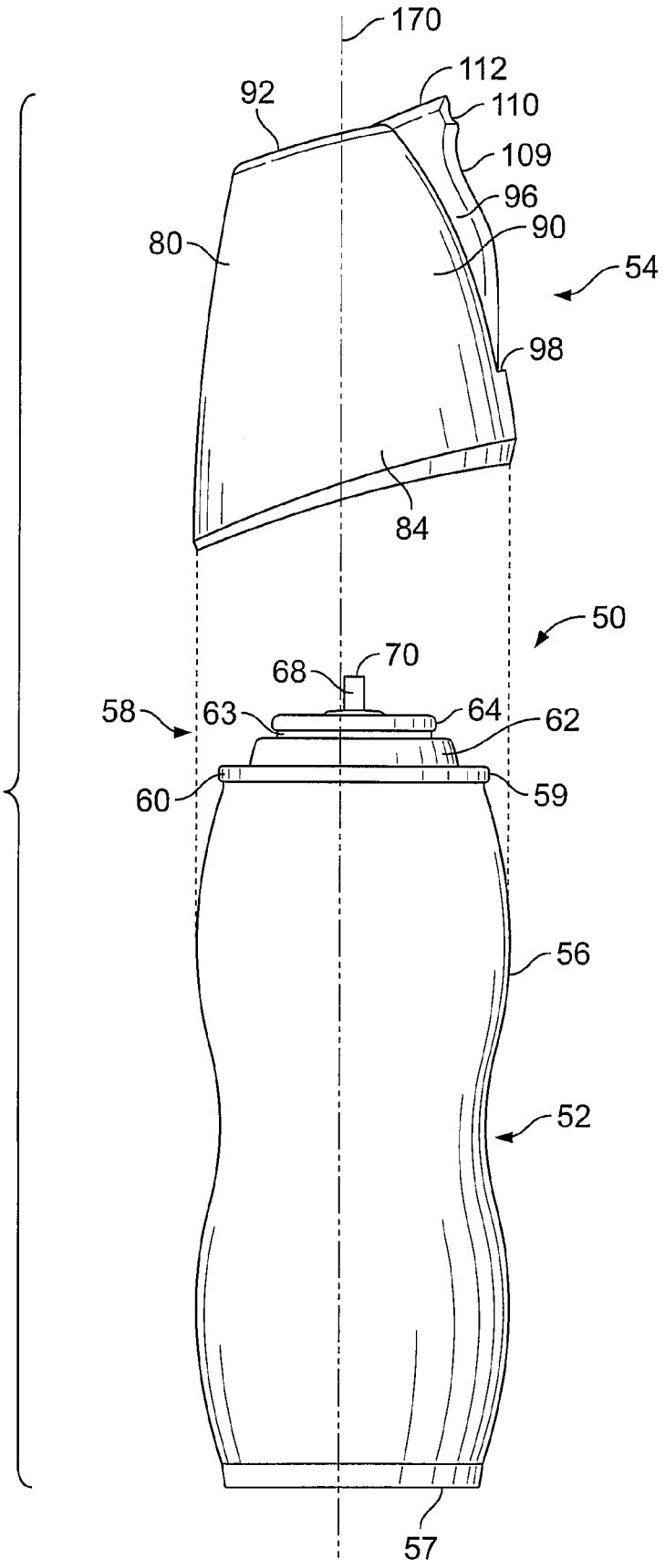
FIG. 1 is an exploded side elevational view of a volatile material dispenser with an overcap removed therefrom.

Referring to the drawings, FIG. 1 depicts one type of a volatile material dispenser 50 that comprises a container 52. An overcap 54 is mounted on the container 52 for dispensing contents from the container 52 (the overcap 54 is shown mounted on the container 52 in FIGS. 10A-10C, 11A, 11B, 12A, 12B, and 13). The container 52 is a typical aerosol container known in the art. The container 52 includes a body 56 that extends upwardly from a base portion 57 and tapers inwardly toward a closure 58 that encloses the contents of the container 52. The closure 58 includes a lower annular bead or ledge 59 that forms a lower end 60 of the closure 58. The lower bead 59 is crimped over a top end of the body 56 of the container 52, wherein material forming the lower bead 59 further forms a central portion 62 that is disposed inwardly of the lower bead 59 and extends upwardly from the lower end 60 of the closure 58. The central portion 62 includes an annular groove 63 that leads into an upper annular bead or ledge 64. A valve stem 68 extends upwardly from the closure 58 and includes a discharge end 70, wherein the contents of the dispenser may be dispensed therethrough. The valve stem 68 may be a vertical action or tilt action valve stem 68. Although the container 52 is described in detail herein, the overcap 54 may be utilized with any other container known in the art.

The container 52 may contain any type of material adapted to be dispensed. For example, the container 52 may include cleaners, shave gels, air fresheners or deodorizers, insect repellant, or any other material. The material may be in concentrate form and/or mixed with other components, such as, for example, a propellant. Any type of propellant known to those in the art may be used with and/or without the material. Other additives may also be included, such as, for example, fragrances, sunscreen, moisturizers, and/or preservatives.

Figure 2:
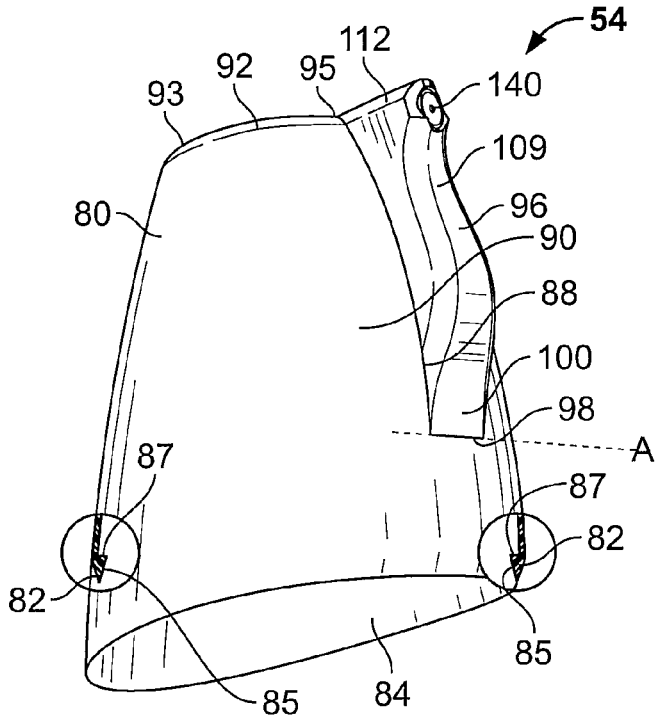
FIG. 2 is a bottom isometric view of the overcap of FIG. 1 with portions thereof cut out to depict an inner ledge thereof.
Figure 3:
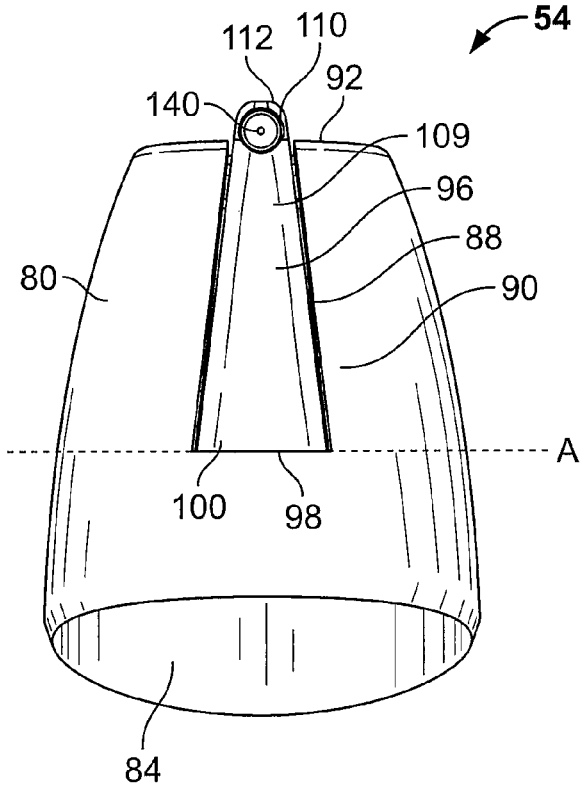
FIG. 3 is a front elevational view of the overcap of FIG. 1.
Figure 4:
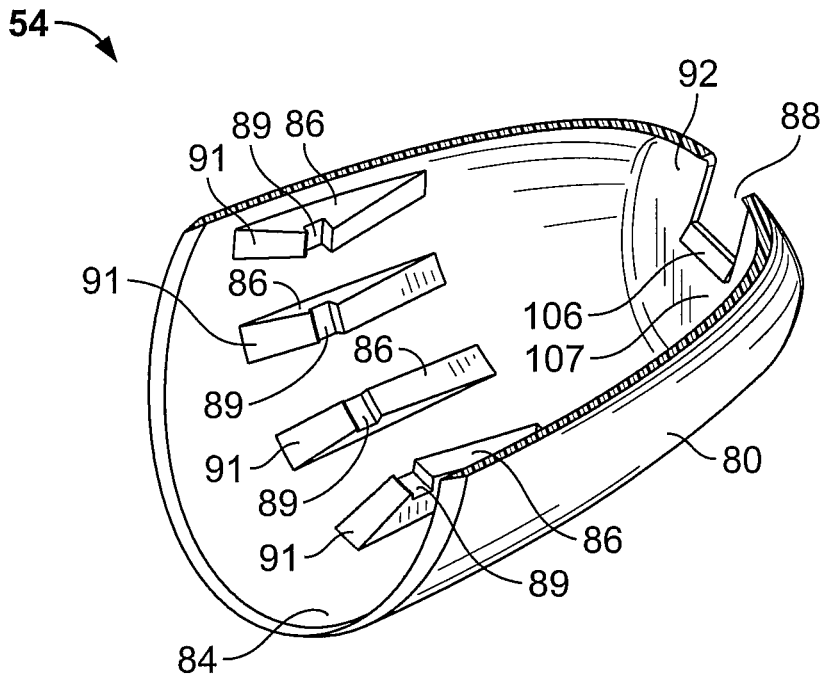
FIG. 4 is a fragmentary isometric view of a portion of the overcap of FIG. 1, wherein the trigger has been omitted for clarity.
Figure 7:
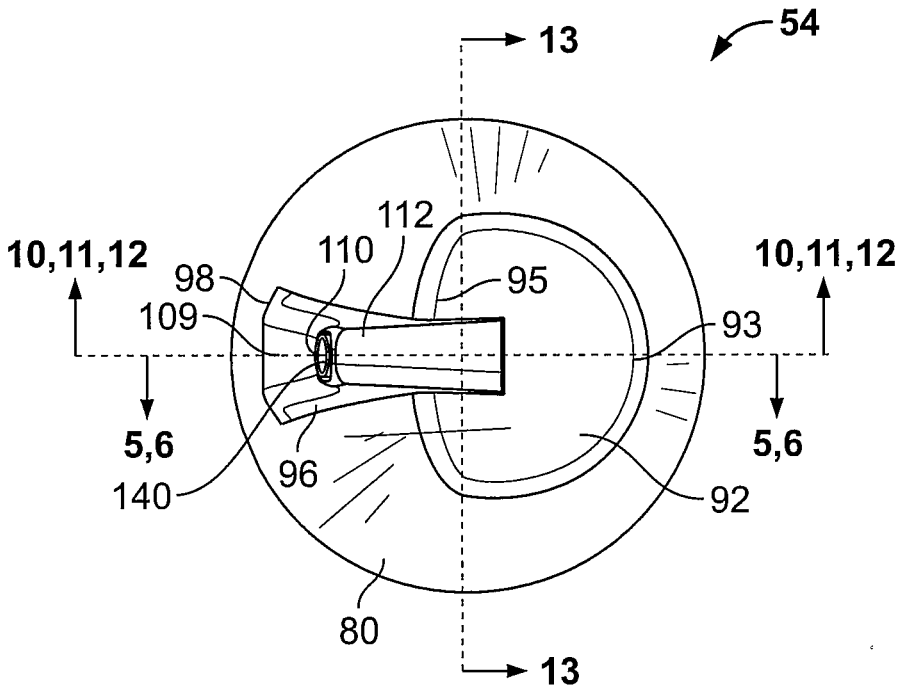
FIG. 7 is a top plan view of the overcap of FIG. 1.

A first embodiment of an overcap 54 adapted for use with the container 52 is depicted generally in FIGS. 2 and 3. The overcap 54 is shown as having a generally frustoconical shape, but also may be any other shape including a shape that may or may not be complementary to the container 52. The overcap 54 includes a housing 80 that may include an annular inner ledge 82 (shown in FIG. 2) disposed around a lower section 84 of the overcap 54. The overcap 54 may be attached to the container 52 by placing the overcap 54 atop the container closure 58 and pressing downwardly such that the lower bead 59 of the container 52 rides up an annular ramped surface 85 to snap into engagement with an upwardly facing surface 87 of the inner ledge 82. In order to remove the overcap 54, an interference between the lower bead 59 of the container 52 and the upwardly facing surface 87 of the overcap 54 must be overcome. Although the inner ledge 82 is shown as annular, the inner ledge 82 may also be segmented to retain the overcap 54 on the container 52.

In a further embodiment, as depicted in FIGS. 4, 5, 6, 10A-10C, 11A, 11B, 12A, 12B, and 13, the housing 80 of the overcap 54 includes a plurality of inwardly extending projections 86 having notches 89 formed therein. The overcap 54 is attached to the container 52 by placing the overcap 54 atop the container closure 58 and pressing downwardly such that the lower bead 59 of the container 52 rides up angled surfaces 91 forming the projections 86 to snap into engagement with the notches 89 of the overcap 54. Although the projections 86 are depicted as discrete and separate projections, a single annular projection may alternatively be utilized. Still optionally, the overcap 54 may contain a combination of the inner ledge 82 with the upwardly facing surface 87 and/or one or more projections 86 having notches 89 formed therein to secure the overcap 54 to the container 52.

The overcap 54 also may be secured to other parts of the container 52, such as, for example, the upper bead 64 or some other portion of the container 52. Other types of engagement mechanisms well-known to those in the art may also be used to secure the overcap 54 to the container 52 including engagement mechanisms that are permanent and prevent removal of the overcap 54 from the container 52 or non-permanent and do not prevent removal of the overcap 54 from the container 52.

As best seen in FIGS. 1, 2, 4, 5, 6, and 10A, the housing 80 further includes an aperture 88 that is formed within a side section 90 of the housing 80 and a portion of a top section 92 of the housing 80. As depicted in FIGS. 1, 5, 6, 10A-10C, 11A, 11B, 12A, and 12B, the top section 92 is shown as inclined upwardly between a first side 93 and a second side 95 of the housing 80. Alternatively, the top section 92 may be inclined at any angle and/or not inclined.

Figure 14:
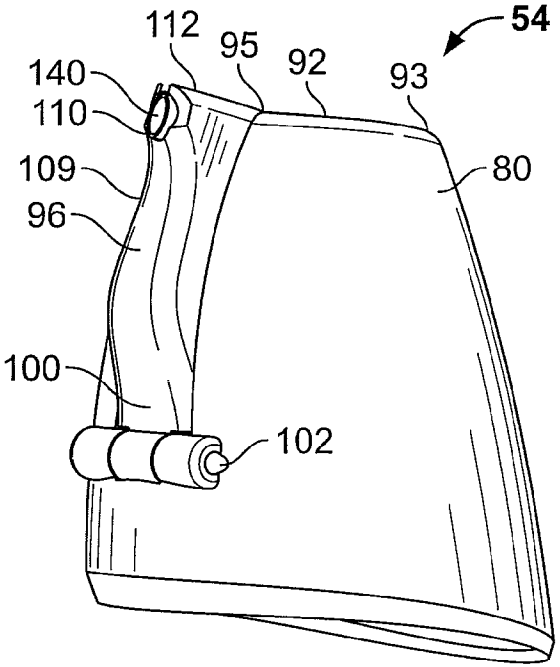
FIG. 14 is a bottom isometric view of a further embodiment of an overcap.

FIGS. 1-3, 5-7, 10A-10C, 11A, 11B, 12A, and 12B depict a trigger 96 that is integrally attached to the housing 80 by a hinge 98 located at a first end 100 of the trigger 96. The hinge 98 is preferably a living hinge, but may also be any other type of hinge or attachment means that may act to facilitate securement of the trigger 96 to the housing 80, while at the same time allowing rotational movement about a pivot axis (for example, axis A shown in FIGS. 2, 3, 5, and 6). The hinge 98 is integrally attached in any of the manners described herein such that the trigger 96 is permanently secured to the housing 80 and the user is unable to remove the trigger 96 from housing 80. Optionally, as shown in FIG. 14, a pin 102 may be used instead of and/or in combination with the hinge 98 to secure the trigger 96 to the housing 80. Any hinge or other attachment mechanism may be used such that the first end 100 of the trigger 96 adequately engages the housing 80 at the hinge 98 and is managed throughout the static and kinetic action of the trigger 96 to ensure retention of the trigger 96 between the hinge 98 and a second end of the trigger 103 and to ensure retention of inner surfaces 108*a*, 108*b* of latches 104, 106, discussed in greater detail hereinafter.

Referring to FIGS. 5, 6, 8A, 8B, and 9, the trigger 96 is substantially hollow to accommodate other pieces of the overcap 54, as discussed in greater detail hereinafter. The trigger 96 extends outwardly from the housing 80 at an angle that is convenient for a user to grasp, and as seen in FIGS. 1, 10A-10C, 11A, 11B, 12A, 12B, and 13, does not extend outwardly past a footprint or outermost dimension of the container 52. One benefit of this feature is that the trigger 96 is not accidentally displaced during transit.

Figure 5:
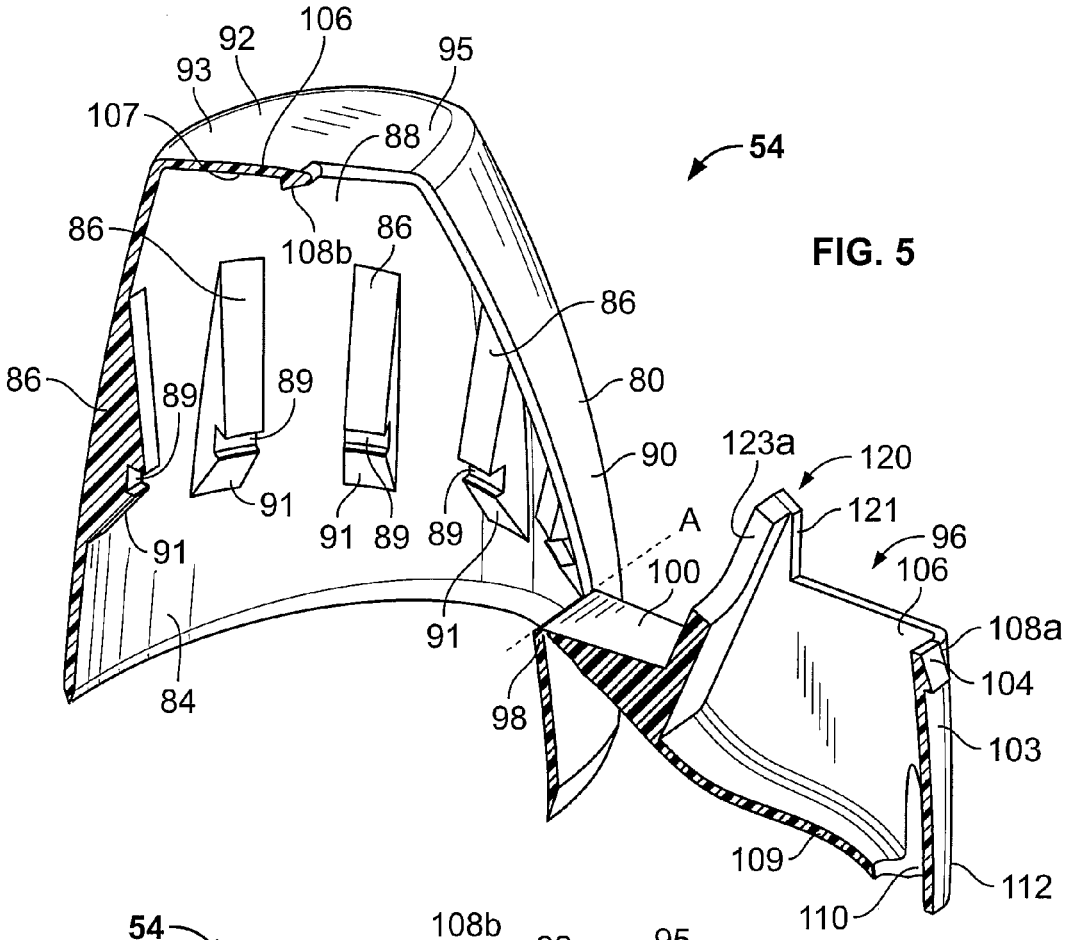
FIG. 5 is a top isometric cross-sectional view of the overcap of FIG. 1 taken generally along the lines of 5-5 of FIG. 7, wherein the trigger is shown in an open position.
Figure 6:
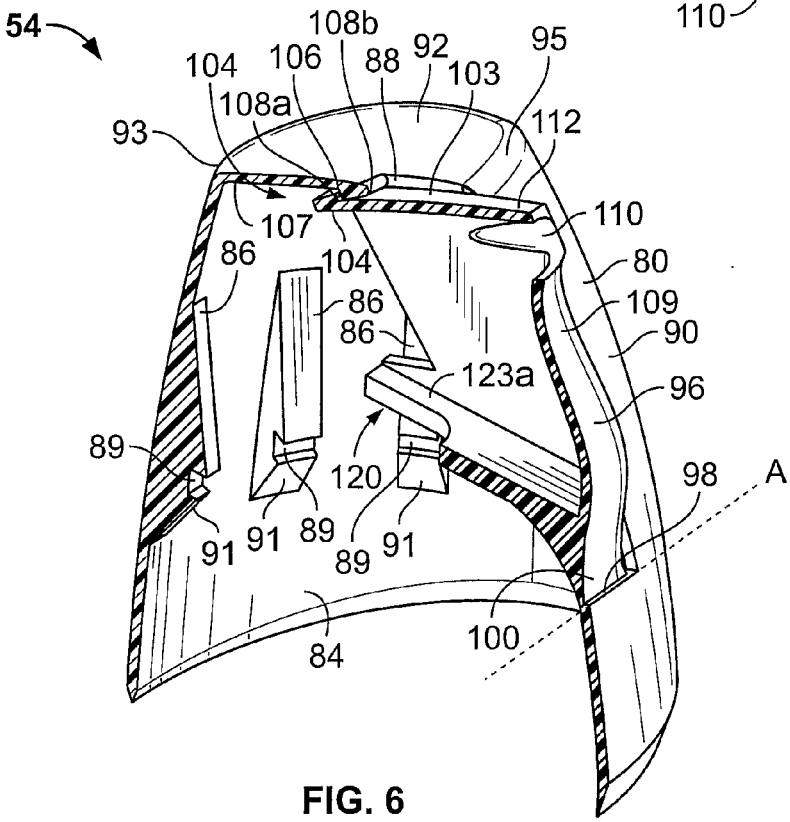
FIG. 6 is a top isometric cross-sectional view of the overcap of FIG. 1 taken generally along the lines of 6-6 of FIG. 7, wherein the trigger is shown in a closed position.
Figure 9:
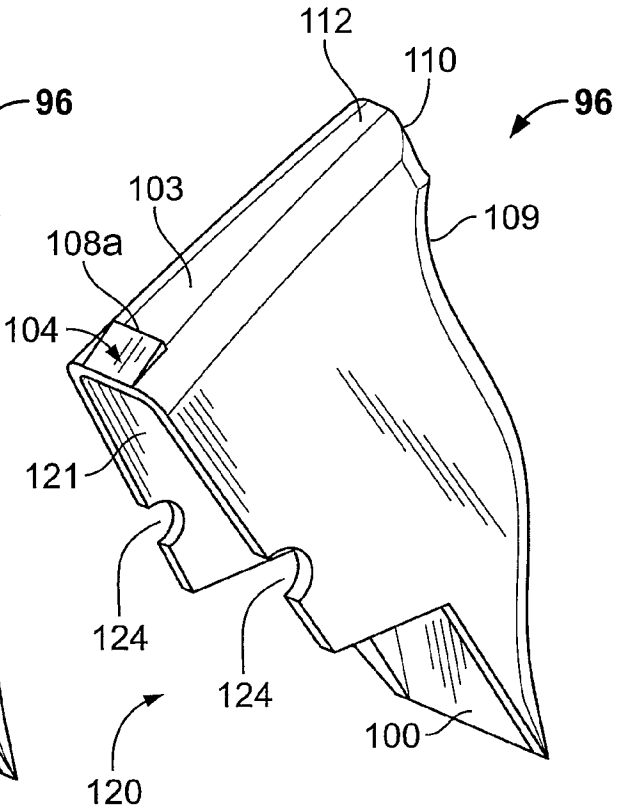
FIG. 9 is a top isometric view of a third embodiment of the trigger.
Figure 10A:
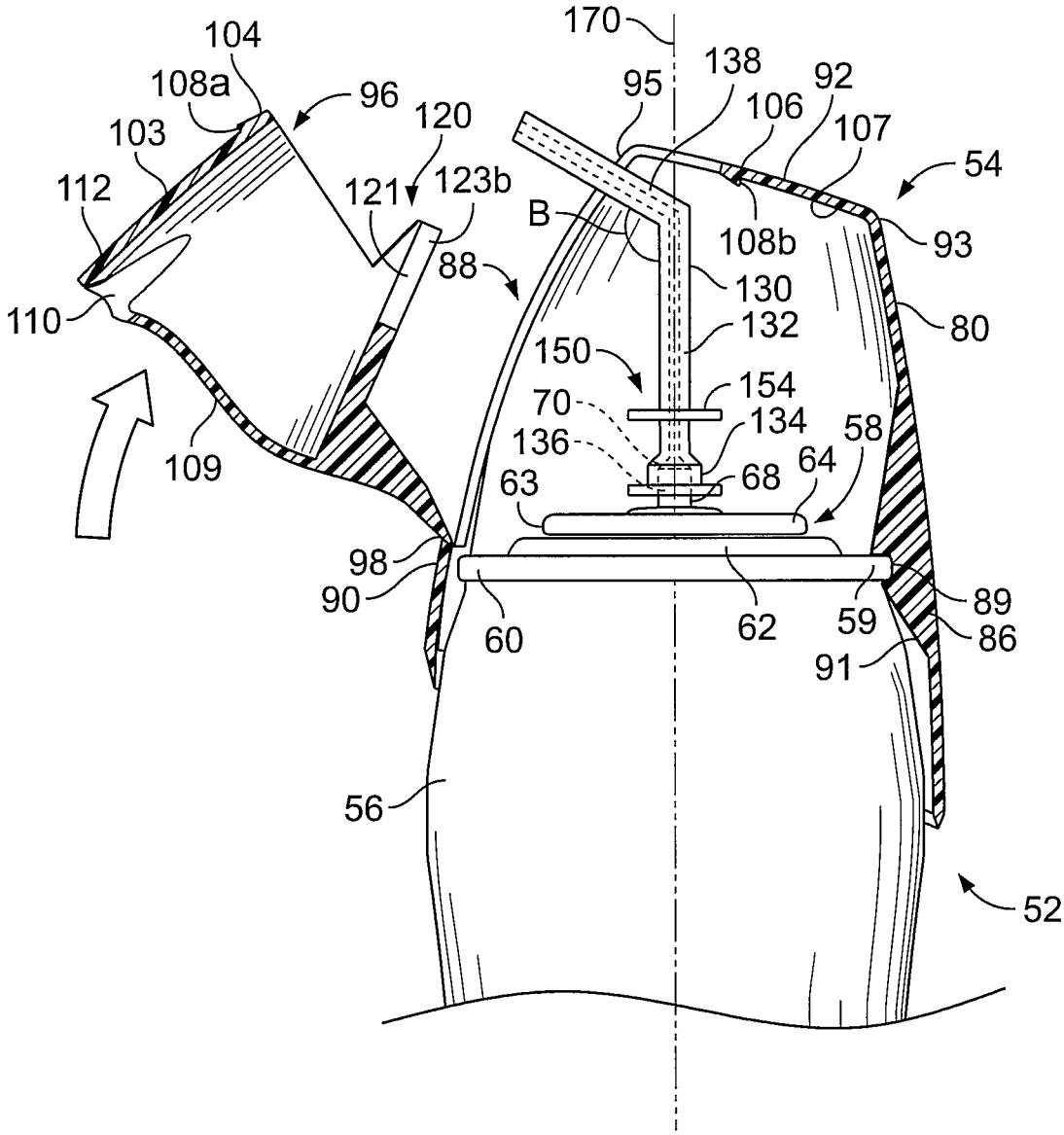
FIGS. 10A-C are cross-sectional views of the overcap of FIG. 1 taken generally along the lines 10-10 of FIG. 7 and embodying the trigger of FIG. 8B with portions behind the cross-sectional plane omitted and the dispenser and a valve-connecting portion shown in full front elevation for clarity, wherein the overcap is shown in the open, closed, and actuated positions, respectively.

As shown in FIGS. 5, 6, 8A, 8B, 9, 10A-10C, 11A, 11B, 12A, and 12B, the first upwardly extending latch 104, or other suitable securement mechanism is located at the second end 103 of the trigger 96 to facilitate securing the trigger 96 to the housing 80. In one embodiment, during manufacture or before first use of the overcap 54, the trigger 96 is rotated from an open position, as seen in FIGS. 5 and 10A, to a closed position, as seen in FIG. 1-3, 6, 10B, 11A, and 12A. As the trigger 96 is rotated to the closed position, the first latch 104 encounters the second downwardly extending latch 106 disposed on a lower surface 107 of the top section 92 of the housing 80, thereby forcing the second end 103 of the trigger 96 and the top section 92 of the housing 80 away from one another and causing the latches 104, 106 to ride along one another. When the first latch 104 passes the second latch 106, the trigger 96 and top section 92 snap into a locking position in which the latches 104, 106 abut one another to prevent outwardly movement of the trigger 96. The latches 104, 106 form a one-way snap feature that allows inward movement of the trigger 96. In an unused state, the trigger 96 is biased outwardly by the hinge 98, thereby forcing the inner surfaces 108*a*, 108*b* of the latches 104, 106, respectively to constantly abut one another, as seen in FIGS. 6, 10A-10C, 11A, 11B, 12A, and 12B. When a user presses inwardly on the trigger 96 in a direction that is generally perpendicular to the valve stem 68, the first latch 104 moves inwardly away from the second latch 106. When pressure is removed, the trigger 96 returns to its biased position in which the inner surfaces 108*a*, 108*b* of the latches 104, 106, respectively, abut one another. Although latches are described in detail herein, other types of one-way securement mechanisms may also be used including one or more of notches, latches, channels, wedges, and/or snaps. The latches 104, 106 may also take any shape that prevents movement in a first direction, but allows movement in a second direction.

As best seen in FIGS. 5, 6, 8A, 8B, 9, 10A-10C, 11A, 11B, 12A, and 12B, a front portion 109 of the trigger 96 includes a discharge channel 110 therethrough to provide an outlet for the material to be dispensed from the container 52. The discharge channel 110 is shown oriented toward a top portion 112 of the front portion 108, but may also be located at any other point in the trigger 96. The discharge channel 110 may be any shape that facilitates the release of the material through the trigger 96.

Figure 8B:
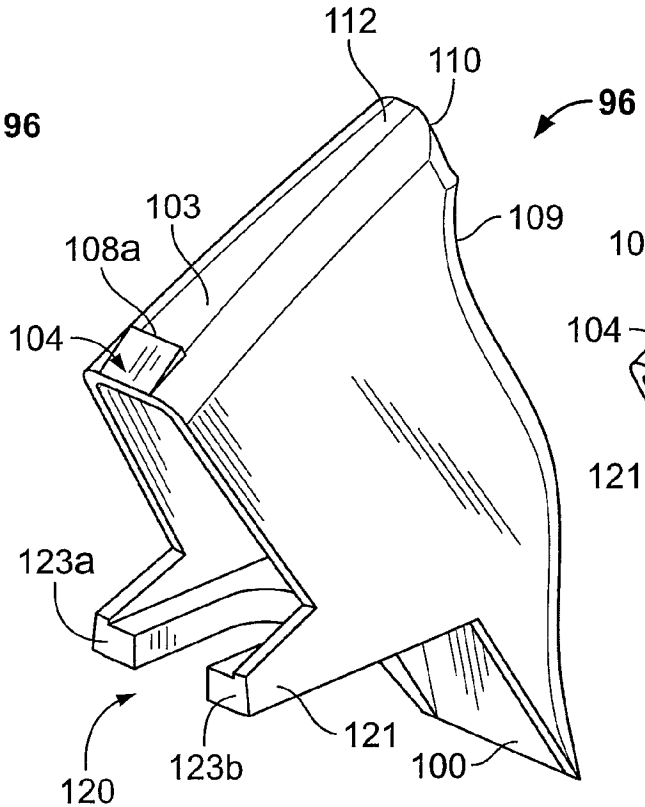
FIG. 8B is a top isometric view of a second embodiment of the trigger
Figure 8A:
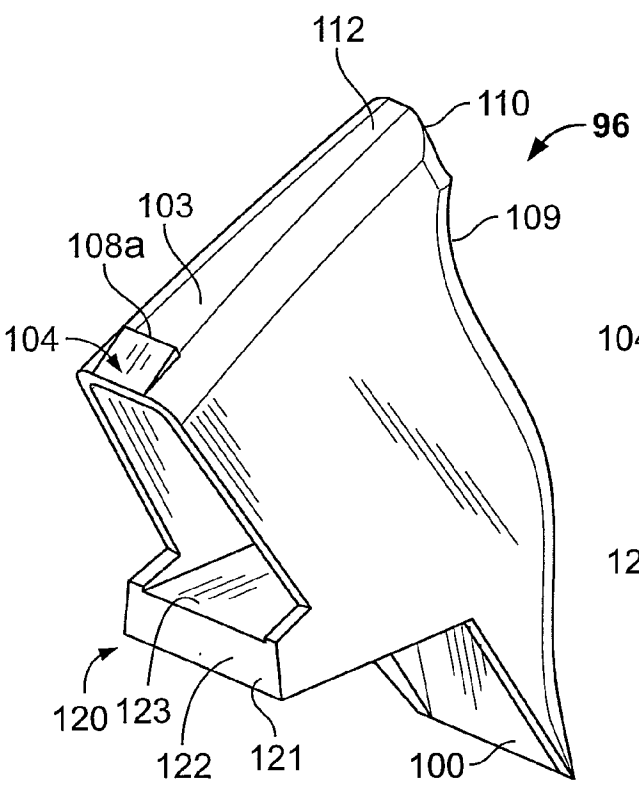
FIG. 8A is a top isometric view of a first embodiment of the trigger.
Figure 10C:
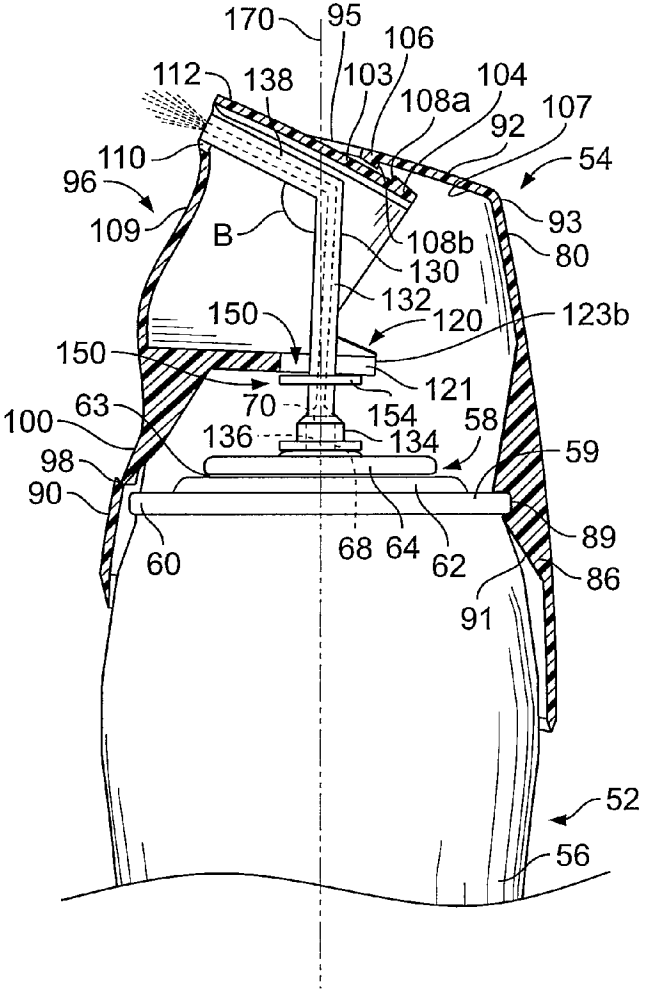
Figure 10B:
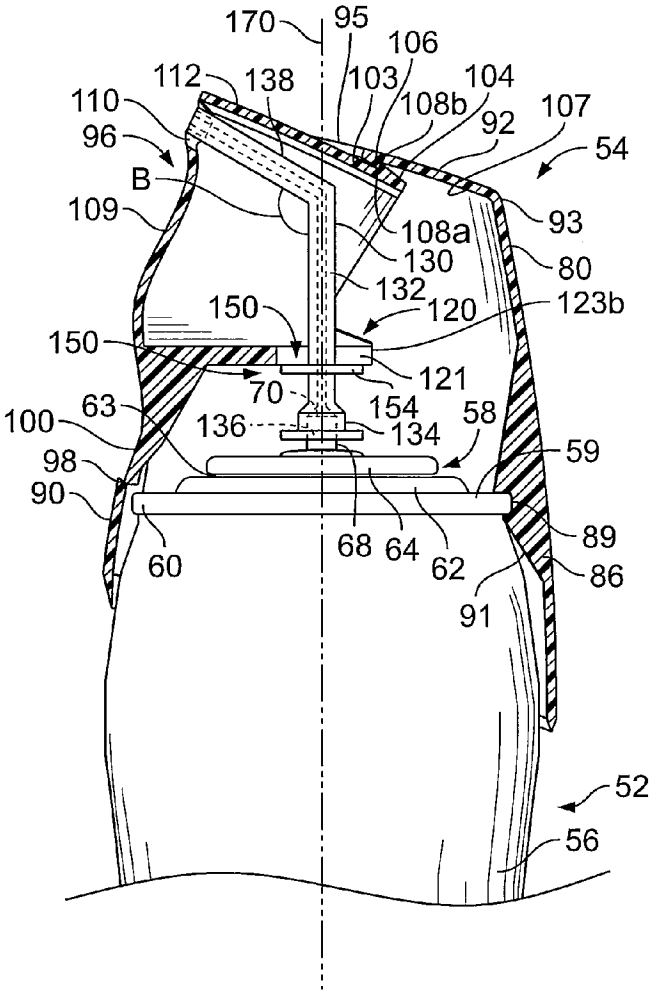
Figure 11B:
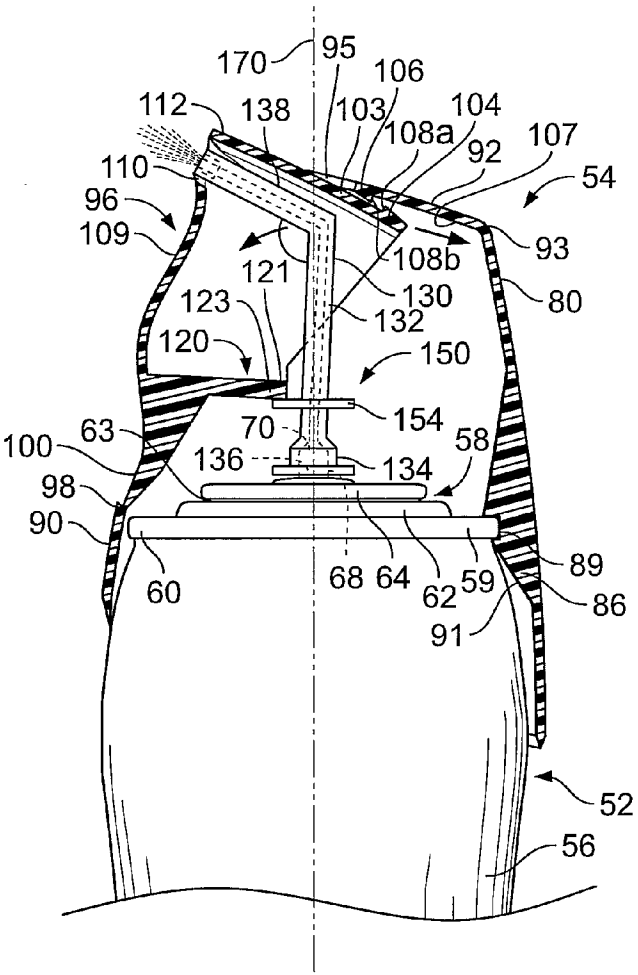
FIGS. 11A and 11B are cross-sectional views of the overcap of FIG. 1 taken generally along the lines 11-11 of FIG. 7 and embodying the trigger of FIG. 8A with portions behind the plane omitted and the dispenser and a valve-connecting portion shown in full front elevation for clarity, wherein the overcap is shown in the closed and actuated positions, respectively.
Figure 11A:
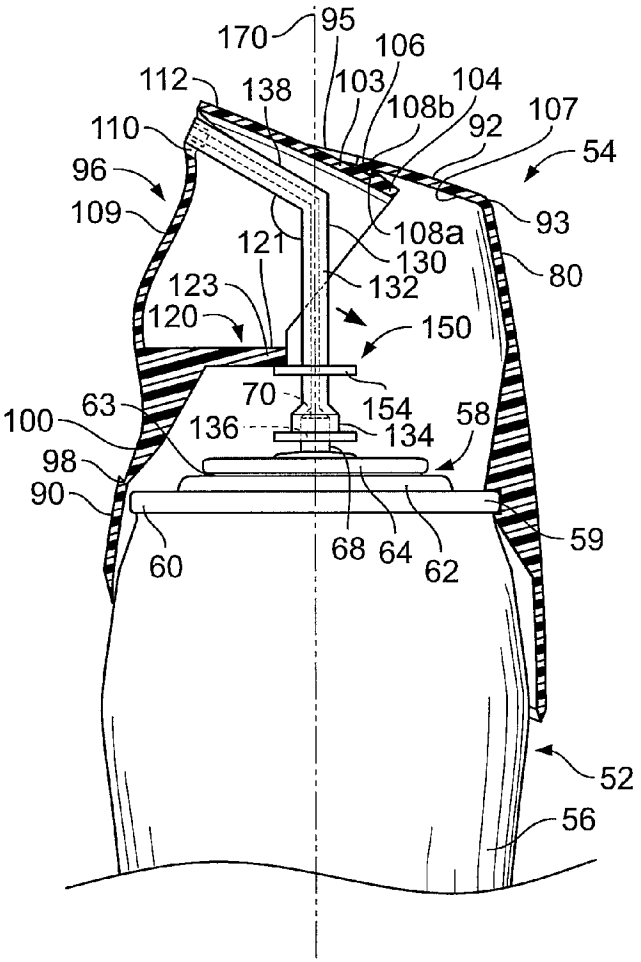

The trigger 96 further includes a contact portion 120 that is located in a rear portion 121 of the trigger 96 between the hinge 98 and the first latch 104, as shown in FIGS. 5, 6, 8A, 8B, 9, 10A-10C, 11A, 11B, 12A, and 12B. Illustratively, the contact portion 120 is shown approximately at a mid-point between the hinge 98 and the latch 104, but may also be located at any other point in the trigger 96. In some embodiments, the contact portion 120 is in the form of a ledge 122 that extends outwardly from the rear portion 121 of the trigger 96. As shown in FIGS. 8A, 11A, and 11B, the ledge 122 extends in a substantially perpendicular manner from the trigger 96 and is formed of a single solid protrusion 123. Further, FIGS. 5, 6, 8B, and 10A-10C depict the contact portion 120 formed of two solid protrusions 123*a*, 123*b*.

Figure 12B:
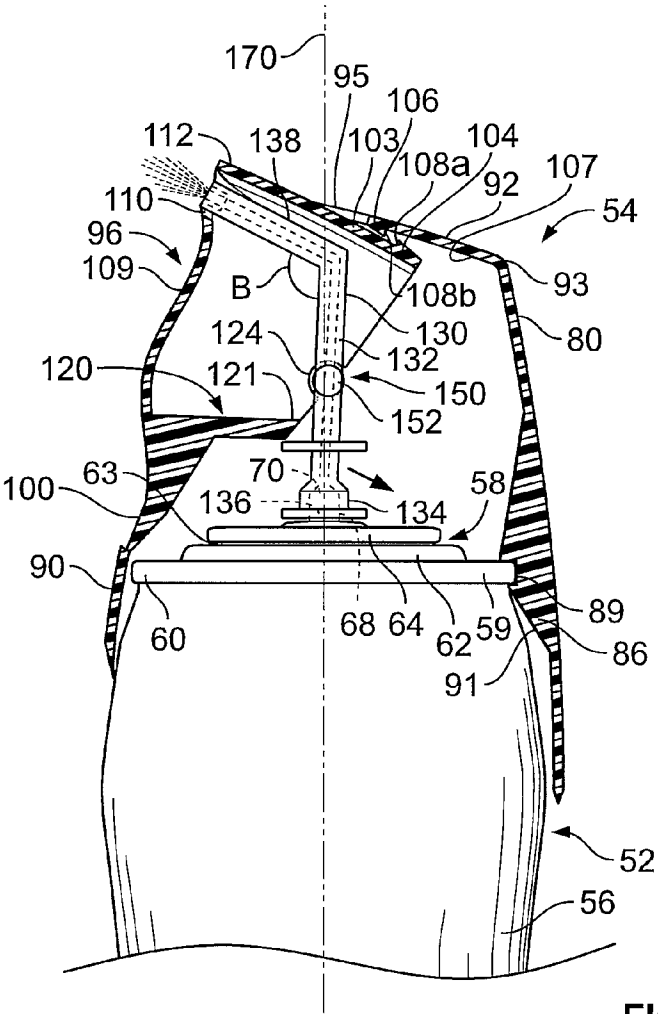
FIGS. 12A and 12B are cross-sectional views of the overcap of FIG. 1 taken generally along the lines 12-12 of FIG. 7 with portions behind the cross-sectional plane omitted and the dispenser and a valve-connecting portion shown in full front elevation for clarity, wherein the overcap is show in the closed and actuated positions, respectively.
Figure 12A:
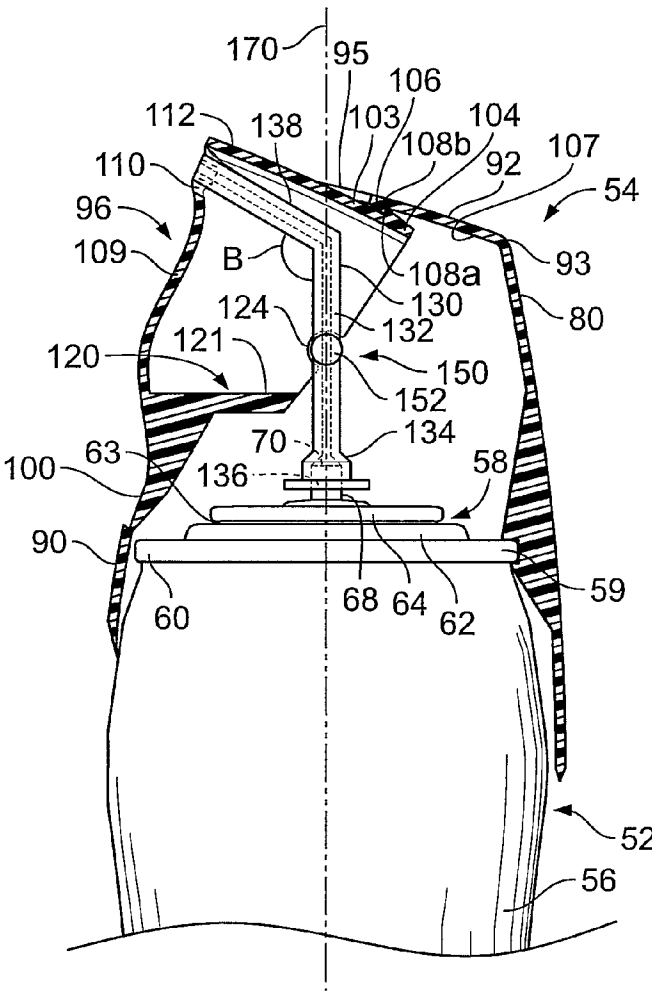

The contact portion 120 of FIGS. 9, 12A, and 12B is in the form of at least one notch 124 formed in the trigger 96. The notch 124 extends inwardly from the rear portion 121 of the trigger 96 toward the front portion 108 of the trigger 96. The notch 124 is depicted as a semi-circular-type cutout in the trigger 96, but also may be a square-shaped cutout, or any other polygonal-shaped cutout that is compatible with a valve-connecting portion 130, as discussed hereinbelow.

Turning now to FIGS. 10A-10C, 11A, 11B, 12A, 12B, and 13, the overcap 54 further includes a valve-connecting portion 130. The valve-connecting portion 130 includes a vertically extending elongate tube portion 132 with a flared end 134 forming an opening 136 that is adapted to engage the valve stem 68. The valve-connecting portion 130 further includes a diagonally extending elongate tube portion 138 integrally formed with the vertically extending tube portion 132 such that fluid can travel through both tube portions 132, 138. The diagonally extending tube portion 138 extends to a point adjacent the discharge channel 110 of the trigger 96, wherein a nozzle 140 inserted into the discharge channel 110 or an need of the diagonally extending tube portion 138 is fluidly coupled to the tube portion 138. As shown in FIG. 10A, 10B, and 10C, an angle B is formed between the tube portions 132, 138, wherein the angle B is manufactured so that the valve-connecting portion 130 fits inside of, and is complementary in shape to the trigger 96.

Figure 13:
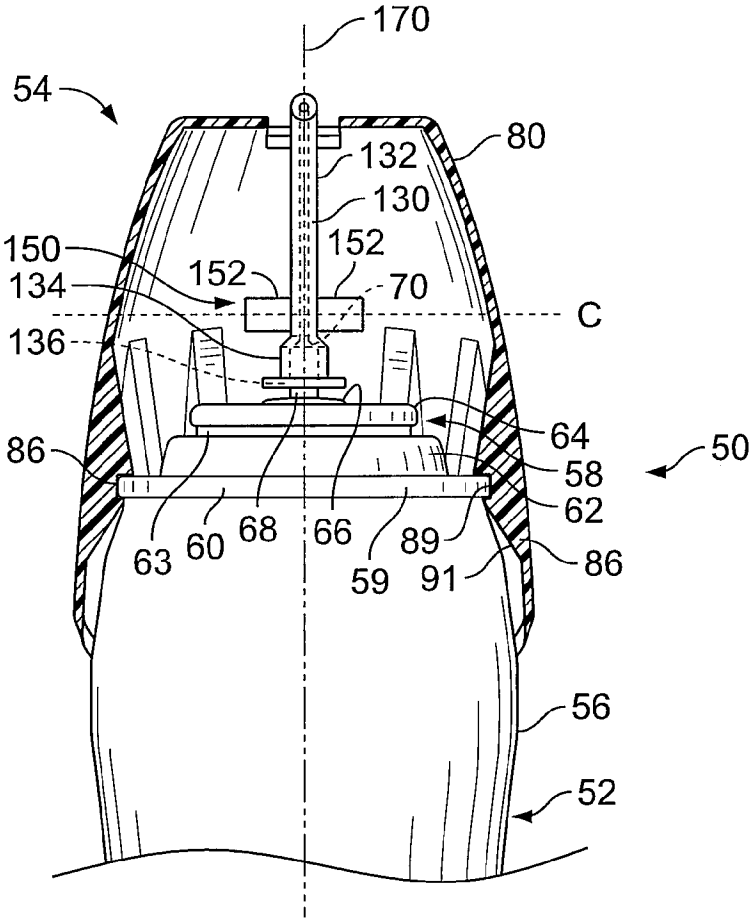
FIG. 13 is cross-sectional view of the overcap of FIG. 10 taken along the lines of 13-13 of FIG. 7 with portions behind the plane omitted and the dispenser and a valve-connecting portion shown in full front elevation for clarity.

As shown in FIGS. 10A-10C, 11A, 11B, 12A, 12B, and 13, the valve-connecting portion 130 further includes a fixture 150 extending therefrom. As shown in FIGS. 12A, 12B, and 13, the fixture 150 may include at least one protrusion 152 attached to the valve-connecting portion 130 and extending outwardly therefrom. The fixture 150 may alternatively include an annular ledge or ring 154 attached to the valve-connecting portion 130 and extending outwardly therefrom, as seen in FIGS. 10A-10C, 11A, and 11B. As seen in FIGS. 10A-10C, 11A, 11B, 12A, 12B, and 13, the fixture 150 extends generally perpendicularly from the valve-connecting portion 130, but may alternatively extend at an incline. The fixture 150 may or may not be integrally manufactured with the valve-connecting portion 130. The fixture 150 is disposed adjacent to or spaced slightly from the flared end 134 of the valve-connecting portion 130.

Pressing the trigger 96 inwardly toward the container 52 starts the actuation process in order to dispense fluid housed in the container 52. The trigger 96 is pressed in a direction generally parallel to a plane defined by the fixture 150. For example, in FIG. 13, the trigger 96 may be pressed inwardly in a direction substantially parallel to a plane C. Pressing the trigger 96 inwardly causes the trigger 96 to rotate about the hinge 98 and move inwardly, thereby causing the first latch 104 to move inwardly away from the second latch 106. In one embodiment, as the trigger 96 moves inwardly, the contact portion 120 in the rear portion 121 of the trigger 96 contacts the fixture 150, thereby causing downward pressure on the fixture 150. Downward pressure on the fixture 150 is transferred to the valve-connecting portion 130, which pressure is thereafter translated into a downward and sideways movement of the valve stem 68 to actuate same. Specifically, referring to FIGS. 10A-10C, in which the contact portion 120 is in the form of two solid protrusions 123*a*, 123*b* (only 123*b* can be seen in FIGS. 10A-10C) and the fixture 150 is in the form of an annular ring 154, the protrusions 123*a*, 123*b* contact edges of the annular ring 154 to cause downward movement of the valve-connecting portion 130 and actuation of the valve stem 68. Similarly, in FIGS. 11A and 11B, the ledge 122 of the trigger 96 presses downwardly on the annular ring 154 of the valve-connecting portion 130 to actuate the valve stem 68. Alternatively, in FIGS. 12A and 12B, the at least one notch 124 contacts the at least one protrusion 152 to cause actuation of the valve stem 68.

In other embodiments, the trigger 96 may contact the fixture 150 at other points that could cause actuation of the valve stem 68. For example, the trigger 96 may contact the fixture 150 at a point that causes sideways pressure on the fixture 150. In such an embodiment, a tilt-type valve stem 68 known in the art may be used in conjunction with the valve-connecting portion 130.

Although the fixture 150 is described herein as an annular ring 154 or at least one protrusion 152, alternative shapes and designs may be utilized. For example, the annular ring 154 may alternatively be, for example, circular, square-shaped, ovular, triangular, or any other polygonal shape. Further, the at least one protrusion 152 may be circular, square-shaped, triangular, or any other polygonal shape in cross-section. The fixture 150 may take any form so long as it provides an interaction point for the contact portion 120 of the trigger 96 to facilitate actuation of the valve stem 68.

Once the valve stem 68 is actuated, aerosolized material moves upwardly in a direction substantially parallel to a longitudinal axis 170 of the container 52 and out the valve stem 68. Material thereafter moves through the vertically and diagonally extending tube portions 132, 138 of the valve-connecting portion 130 and is dispensed through the nozzle 140 disposed in the discharge aperture 110 in the trigger 96 or the tube portion 138 of the valve-connecting portion 130. The nozzle 140 is separate from the trigger 96 and valve-connecting portion 130, but may alternatively be integral with the trigger 96 and/or valve-connecting portion 130.

In other embodiments of the present invention, the apparatuses, methods, and combinations are directed to assisting a user in operating a trigger 96 of the present invention. For example, one or more exterior sidewalls and/or portions of the overcap 54 and/or trigger 96 may be shaped to assist a user in gripping the volatile material dispenser 50. Such shapes include, for example, a concave shape (for example, U-shaped) and/or a convex shape, and/or an S-shape. Additionally, one or more exterior side walls or portions of the overcap 54 and/or trigger 96 may include one or more ribs, bulges, bumps, knobs, protrusions, distensions, and/or protuberances to assist a user in gripping one or more areas of the trigger 96. Illustratively, these gripping assists may be in any pattern, including, for example, horizontal, vertical, curved, serpentine, zigzag, and/or diagonal, to assist a user in gripping the overcap 54 and/or trigger 96. Combinations of the above gripping assists may also be used in the present invention.

Two or more parts and/or surfaces described herein may be attached together in a permanent or non-permanent manner by any fastening, securing, and/or joining techniques known to those skilled in the art. Examples include mechanically, chemically, and/or heat fastening, securing, and/or joining together two or more surfaces of metal, plastic, glass, rubber, paper, and/or ceramic, and combinations thereof. A chemical agent useful in the present invention to fasten, secure, and/or join two or more surfaces together includes, for example, an adhesion promoter, a binding agent (for example, a cyanoacrylate adhesive, or an epoxy putty), a bonding agent (for example, a hot melt adhesive), a crosslinking agent, a curing agent (for example, a UV light curing adhesive), a fixative agent, a sticking agent, and/or a vulcanizing agent, and combinations thereof. Exemplary chemical agents useful in the present invention include those described in, for example, The Handbook of Industrial Chemical Additives—2nd Edition, Gower Publishing Limited (Mar. 28, 1998). Additional examples of chemical agents useful in the present invention include those described in the Merck Index, Thirteenth Edition, John Wiley & Sons, 13th edition (October 2001). Heat fastening, securing, and/or joining techniques useful in the present invention include, for example, ultrasound, heat or sonic staking, and/or laser welding or joining techniques. Mechanical techniques useful in the present invention, include, for example, the use of tabs, protrusions, hooks, clamps, fasteners, ties, fastening strips (for example, Velcro®), adhesive tape (for example, two sided tape), rivets, soldering, brazing, and/or welding, and combinations thereof. Combinations of the above fastening, securing, and/or joining techniques and agents may be used in the present invention.

The overcap 54, trigger 96, valve-connecting portion 130, and/or nozzle 140 are made from any suitable material including, for example, metal, glass, rubber, paper, ceramic and/or plastic such as, for example, nylon, polypropylene, polyethylene, polystyrene, acetal, toughened acetal, polyketone, polybutylene terephthalate, high density polyethylene, polycarbonate, and/or ABS, and combinations thereof.

The overcap 54, trigger 96, valve-connecting portion 130, and/or nozzle 140 may be made using any desired method known to those skilled in the art, including, for example, injection molding and/or a blow molding process. Metallurgy techniques known to those skilled in the art are also useful in the present invention in making the overcap 54, trigger 96, valve-connecting portion 130, and/or nozzle 140 described herein.

Any of the embodiments described herein may be modified to include any of the structures or methodologies disclosed in connection with other embodiments.

INDUSTRIAL APPLICABILITY

The present invention provides volatile material dispensers for aiding in dispensing a volatile material from a container. The dispensers are in the form of overcaps that are attached to a container, wherein each of the overcaps includes a trigger for actuating the dispenser to dispense the volatile material therefrom. The overcaps and triggers exhibit improved ease of use in that they are easy to grip and the user needs to exert little pressure on the trigger to dispense the volatile material therefrom.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A method of actuating a volatile material dispenser, comprising:

providing a volatile material dispenser, wherein the dispenser includes a housing having a side section depending from a top section, the housing adapted to be mounted on a container having a valve stem with a discharge end, a valve-connecting portion adapted to engage the valve stem, a fixture extending from the valve-connecting portion, a trigger having a discharge aperture, wherein the trigger is integrally attached to the housing entirely below a plane formed by the fixture and on a same side of the side section as the discharge aperture, and a contact portion disposed in the trigger; and pressing the trigger in a direction generally parallel to the plane defined by the fixture, such that the trigger movement allows the contact portion to move into contact with the fixture to thereby displace the valve-connecting portion.

2. The method of claim 1, further including the step of providing a container.

3. The method of claim 1, wherein a first end of the trigger is integrally attached to the housing by a living hinge and the trigger includes a hook that attaches a second end of the trigger to the housing.

4. The method of claim 3, wherein the pressing step includes the step of displacing the second end of the trigger away from the housing.

5. The method of claim 4, further including the step of releasing the trigger to allow the second end of the trigger to move toward and be stopped by the hook.

6. An overcap for a volatile material dispenser, comprising:

a housing including a side section depending from a top section, the housing adapted to be mounted on a container having a valve stem with a discharge end;

a valve-connecting portion adapted to engage the valve stem;

a fixture extending from the valve-connecting portion;

a trigger attached to the side section of the housing by a hinge, wherein the hinge is entirely disposed below a plane formed by the fixture and the hinge is disposed on a same side of the side section of the housing as a discharge aperture; and a contact portion disposed in the trigger for moving into contact with the fixture and applying pressure to the valve-connecting portion to actuate the valve stem.

7. The overcap of claim 6, wherein the fixture extending from the valve connecting portion comprises at least one protrusion.

8. The overcap of claim 7, wherein the contact portion disposed in the trigger comprises at least one notch.

9. The overcap of claim 6, wherein the fixture extending from the valve-connecting portion comprises an annular ring.

10. The overcap of claim 9, wherein the contact portion disposed in the trigger comprises a ledge extending therefrom.

11. The overcap of claim 6, wherein the hinge is a living hinge.

12. The overcap of claim 6, wherein the trigger is integrally attached to the housing.

13. The overcap of claim 6, wherein the valve-connecting portion extends to a point adjacent the discharge aperture of the trigger.

14. The overcap of claim 1, in combination with a container.

15. An overcap for a volatile material dispenser, comprising:

a housing having a side section depending from a top section, the housing adapted to be mounted on a container having a valve stem with a discharge end;

a valve-connecting portion adapted to engage the valve stem;

a fixture extending from the valve-connecting portion;

a trigger having a portion extending outwardly from the side section of the housing, the portion of the trigger having a discharge aperture, wherein the trigger is integrally attached to the housing below a plane formed by the fixture; and a contact portion on the trigger for moving into contact with the fixture to thereby displace the valve-connecting portion.

16. The overcap of claim 15, wherein the trigger is integrally attached to the housing by a living hinge.

17. The overcap of claim 15, wherein the trigger comprises at least one of a concave shape, convex shape, and an S-shape.

18. The overcap of claim 15, in combination with a container.

19. The overcap of claim 15, wherein the housing is inclined upwardly between a first side and a second side thereof.

20. The overcap of claim 15, wherein the housing includes an aperture formed within the side section of the housing.

* * * * *